United States Patent [19]

Ailshie

[11] 3,970,108

[45] July 20, 1976

[54] PRIORITY HYDRAULIC CONTROL VALVE

[75] Inventor: Roger Howard Ailshie, Lewis, Kans.

[73] Assignee: Cross Manufacturing, Inc., Lewis, Kans.

[22] Filed: Oct. 23, 1973

[21] Appl. No.: 408,930

[52] U.S. Cl. ..... 137/596.13; 91/446; 137/596

[51] Int. Cl.[2] ..... F17D 3/00

[58] Field of Search ..... 137/117, 118, 596, 596.12, 137/596.13, 119, 625.69; 91/446 X, 468, 411 R, 420

[56] References Cited

UNITED STATES PATENTS

| | | | |
|---|---|---|---|
| 2,745,433 | 5/1956 | Schneider et al. | 137/596.13 |
| 2,873,762 | 2/1959 | Tennis | 137/596.13 |
| 3,216,446 | 11/1965 | Schmiel | 137/625.69 |
| 3,229,717 | 1/1966 | Rice | 137/117 |
| 3,283,773 | 11/1966 | Lowman | 137/117 |
| 3,415,265 | 12/1968 | Cleminshaw et al. | 137/117 |
| 3,534,774 | 10/1970 | Tennis | 137/596 |
| 3,815,477 | 6/1974 | Ailshie et al. | 137/596.13 |

FOREIGN PATENTS OR APPLICATIONS

| | | | |
|---|---|---|---|
| 1,000,500 | 8/1965 | United Kingdom | 137/596 |

*Primary Examiner*—Martin P. Schwadron
*Assistant Examiner*—George L. Walton
*Attorney, Agent, or Firm*—Edward L. Brown, Jr.

[57] ABSTRACT

A valve section which establishes priority flow in a valve assembly having a plurality of directional control open-center valves each for controlling flow between an associated hydraulic motor and a common power passage from a single source of motive fluid, wherein flow to one of the motors is afforded priority during simultaneous operation of it and another motor. The associated valve section of the priority motor having a conventional load check valve opened by pressure in the common power passage while the load check of the non-priority valve section is opened by pilot pressure in its open-center passage.

3 Claims, 2 Drawing Figures

PRIORITY HYDRAULIC CONTROL VALVE

BACKGROUND OF THE INVENTION

In a hydraulic circuit including a plurality of series-connected valves all supplied by a common source of fluid, the normal method of achieving priority flow to one of the valves ahead of another is to utilize some form of flow divider device such as U.S. Pat. No. 3,229,717. In the present invention, the priority is achieved by separate control of the load check in each valve section. In the valve section claiming priority, the load check can be a conventional type which opens the power passage to one of the motor ports merely by pressure in the power passage. In the non-priority sections, the load checks are opened by pressure build-up piloted from the open-center passages of their particular valve section. When the upstream priority section and non-priority section are actuated, the open-center flow through the valve sections in the stack is blocked causing build-up in the power passage. Since the non-priority section requires pressure in its open-center for fluid to flow to its associated motor, the blockage of the upstream open-center flow by the priority valve prevents the non-priority valve from actuating its motor until the priority valve again opens up the open-center flow.

It is therefore the principal object of the present invention to provide a priority valve section in a stack utilizing conventional valve block castings.

Another object of the invention is to provide a plurality of valve sections in a common stack with the upstream sections always having priority over that section or sections downstream therefrom.

Figure 1:
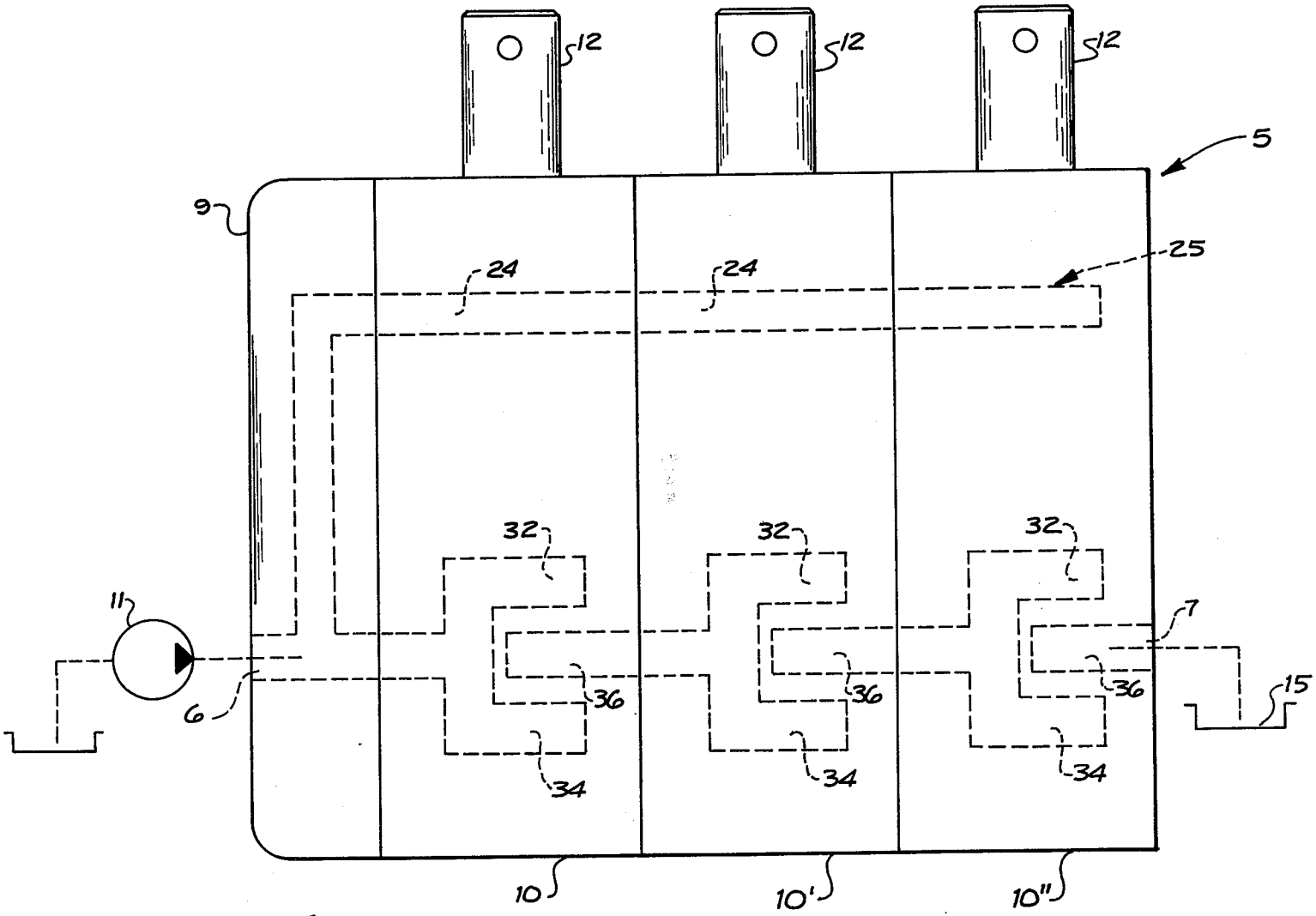
Figure 2:
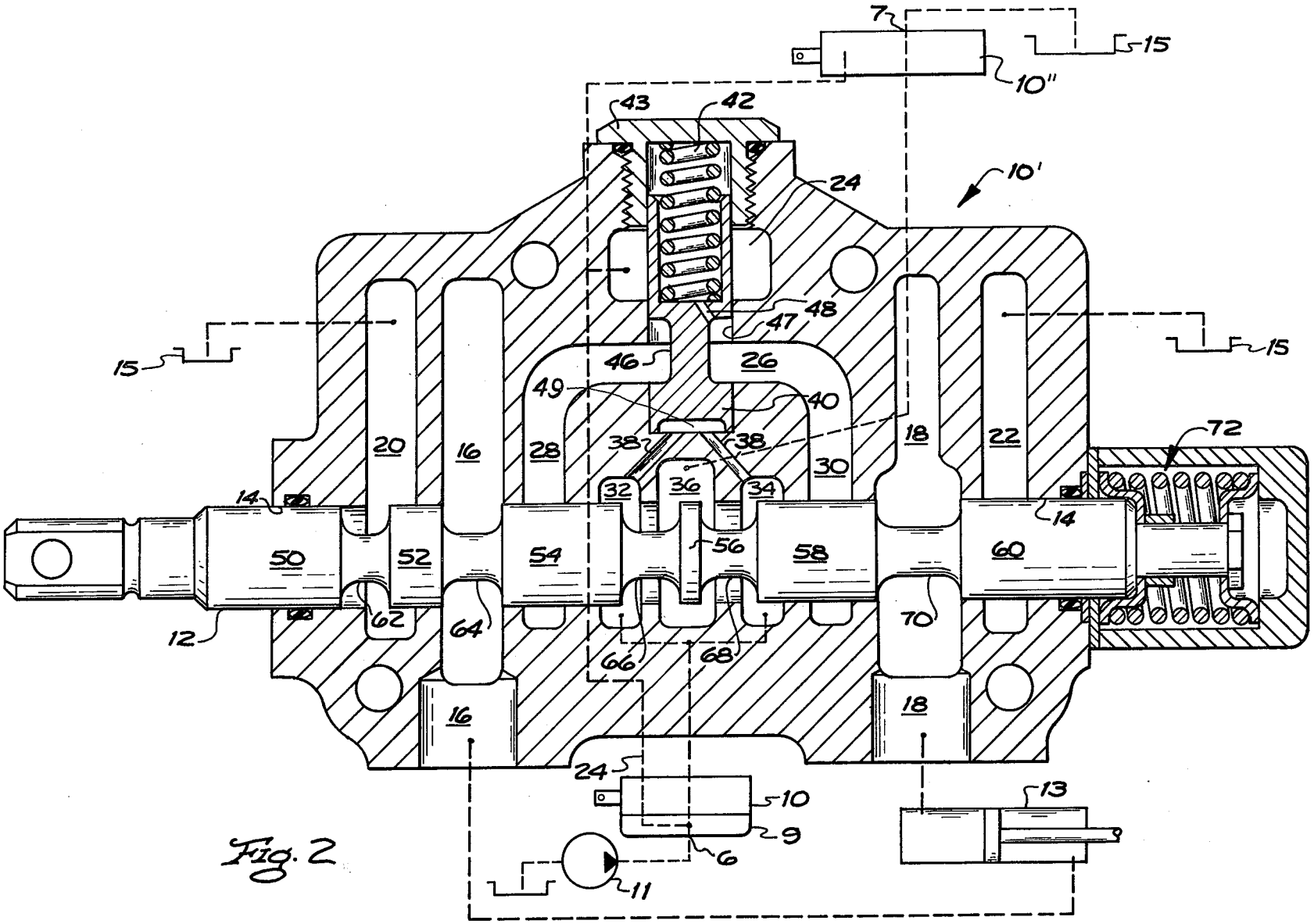

These and other objects and advantages of the present invention are specifically set forth in or will become apparent from the following detailed description of preferred forms of the invention when read in conjunction with the accompanying drawings, wherein:

FIG. 1 is a partially schematic representation of a valve assembly and hydraulic system incorporating the principles of the present invention; and FIG. 2 is a longitudinal cross-sectional view of a non-priority valve section constructed in accordance with the invention.

Referring now more particularly to FIG. 1 of the drawings, a stack valve assembly 5 includes a pressure fluid inlet port 6 connected with a source of motive fluid, pump 11, and an outlet port 7 communicating with a low pressure reservoir or sump 15. Assembly 5 includes a plurality of control valve sections 10, 10′ and 10″ each having interconnected central flow through open-center passages 32, 34, 36, which are conventional in design, adapted to permit through flow from inlet 6 to outlet 7. The valves in the assembly 5 would not have to be of a sectional type, but could also be a mono-block type.

Valve 10′, illustrated in detail in FIG. 2, is the non-priority valve section positioned downstream in the stack from priority section 10. Valve 10′ has a cannelured control spool 12 shiftably mounted in a longitudinal bore 14. A pair of work port passages 16 and 18 are connected to opposite ends of a schematically illustrated double acting hydraulic motor 13. Adjacently positioned to work passage 16 and 18, are return passages 20, 22 which are communicated with the outlet port 7 of the valve assembly.

Communicating with the pressure inlet port 6 through the inlet end section 9 is a blind passage 24 referred to as the power passage. As shown schematically in FIG. 1, each valve section 10, 10′ and 10″ has a passage 24 which interconnects to present a common path 25 leading from inlet 6 to permit motive fluid flow from pump 11 to be delivered in parallel relation to the several valve sections. The open-center passages 32 and 34 of section 10 are connected with inlet port 6. Open-center passage 36 connects with passages 32 and 34 through bore 14 and across spool grooves 66 and 68, as seen in FIG. 2. Passage 36 then leads to the open-center passage of the succeeding valve section 10′, and so on until in the final valve section in assembly 5, the passage 36 opens into outlet port 7.

In FIG. 2, valve section 10′ includes a central bridge passage 26 having branch legs 28, 30 intercepting bore 14 adjacent work passage 16, 18. A vertical bore 47 intercepting bridge passage 26 and power passage 24 is capped by an appropriately sealed plug 43. A load check valve member 40 is shiftable upwardly from its closed position shown, to a position permitting motive fluid flow from passage 24 to bore 14 via groove 46 in member 40, bridge 26, and legs 28, 30.

Load check valve 40 is opened by pressure in chamber 49 formed at the end of bore 47. The lower end of member 40 forms a piston slidable bore 47 defining a servo. Valve 40 is actuated by pressure fluid from open-center passages 32 and 34 via sensing passages 38. Opposing this force is a spring 42 urging valve member 40 toward its closed position, as illustrated. A small bore 48 in member 40 allows fluid flow in and out of the chamber containing spring 42, such flow acting as a damper or dash pot for controlling speed of movement and responsiveness of member 40. Conventional load check valves are opened by pressure in the power passage 24, such as illustrated in U.S. Pat. No. 2,873,762.

Spool 12 is manually shiftable to the left and right of the neutral position against the urgings of a centering spring assemblage 72 which returns the spool to neutral when released. The spool 12 includes a plurality of lands 50, 52, 54, 56, 58, and 60 and interspersed fluid carrying grooves 62, 64, 66, 68, 70 that selectively interconnect adjacent passages 20, 28, 32, 36, 34, 30, 18 and 22 through bore 14 as spool 12 shifts to its different operative positions.

OPERATION

In operation, with all spools of the valve sections 10, 10′ and 10″ in neutral, the motive fluid from pump 11 passes freely through the stack 5 from open-center passages 32 and 34 through adjoining passage 36 on to the open-center passage of the subsequent valves 10′ and 10″ and finally returns to reservoir from outlet port 7. When valve spool 12, or any of the other valves 10 or 10″ in the stack 5 are moved from their neutral position, the open-center flow through the stack is blocked and pressure builds in the parallel power passages 24 of each section in the stack.

In viewing FIG. 2, when spool 12 is singularly moved to the right, lands 54 and 56 block the open-center flow from passages 32 and 34 into passage 36. Pressure builds in passages 32 and 34 as well as upstream power passage 24. Chamber 49 senses the pressure in passages 32 and 34 through passages 38 and opens load check 40, overcoming spring 42. System pressure in power passage 24 now passes over groove 46 of the load check valve 40 and into work passage 16 over spool groove 64 to the motor 13. Fluid on the opposite side of motor 13 is exhausted from work passage 18 across spool groove 70 to return passage 22.

Accordingly, valve section 10' may operate independent from section 10 as well as section 10'' even though they are all supplied from a common source. Valve sections 10 and 10'' are equally independent.

Priority valve section 10 located immediately upstream from non-priority section 10' will have priority flow if both valve spools are actuated together. Valve section 10 having a conventional load check, such as shown in the previously mentioned patent, opens by mere pressure in the power passage 24, while the non-priority load check 40 requires pressure in the open-center passages 32 and 34 before it will open. Valve section 10 could also be identical to downstream valve section 10' and still function in the same manner as the priority section, just as long as it is upstream of the non-priority section. Since priority valve section 10 is upstream from section 10' when its spool calls for flow to its respective motor, the open-center flow across passages 32 and 34 to 36 of valve 10 is blocked, thereby preventing any build-up in the open-center passages of the non-priority section 10' regardless of the position of spool 12 in the non-priority section 10'. As long as priority valve 10 is blocking the open-center flow, neither downstream valve 10' or 10'' can receive any flow to their respective motors. The stack 5 may include additional sections of the non-priority type (FIG. 2) as long as the priority section is positioned upstream therefrom. With two or more non-priority sections in a stack, the upstream non-priority section would have priority over the downstream section since there would not be any pressure build-up in the open-center passage of the downstream section.

While not shown in the drawings, the non-priority valve 10' could have a single passage 38 connecting chamber 49 with passage 36. In a valve section of this type the open-center flow would be in the opposite direction from a single passage splitting into a pair of passages.

Accordingly, the means for actuating the load check valve in response to interruption of flow through and pressure build-up in the open-center passages assures priority flow to the motor associated with the priority valve section even at the expense of reducing flow to other motors being operated at the same time. Yet, the valve utilizes minimal structural variations from other valves in the stack and generally provides a highly economical priority valve structure without requiring an extra valving mechanism.

While preferred forms of the invention are set forth in detail in the foregoing description, the scope and spirit of the invention are to be measured by a fair reading of the appended claims.

Having thus described the invention with sufficient clarity that those skilled in the art may make and use it, what is claimed as new and desired to be secured by Letters Patent is:

1. An open-center valve section which establishes priority flow in the adjacent upstream section in a series of connected open-center valves utilized in a stack, the valve section having a body provided with a bore and a valve element slidable therein defining an open-center flow passage connecting a fluid pressure source to reservoir through the other sections in the stack; a motor passage; a return passage connected to reservoir; a blind-ended power passage connecting the fluid pressure source to said bore; the valve element having a first position with flow to the motor passage blocked and the open-center passage open, allowing fluid from the pressure source to pass to reservoir and second position blocking flow in the open-center passage and allowing flow from the power passage to the motor passage, the improvement comprising:

a load check valve means positioned in the power passage normally springbiasing the power passage closed; and servo means having a piston and connecting chamber separate from said power passage operating the load check valve responsive to pressure in the open-center passage opening the power passage only when sufficient pressure exists in the open-center passage.

2. An open-center directional control valve section as set forth in claim 1, wherein a portion of the load check valve means forms the piston of the servo means.

3. An open-center directional control valve section as set forth in claim 4, wherein a portion of the load check valve means forms the piston of the servo means and pilot passage means connecting the open-center passage with the servo means.

* * * * *